US005829082A

United States Patent [19]

Moreira

[11] Patent Number: 5,829,082

[45] Date of Patent: Nov. 3, 1998

[54] MULTI-FUNCTIONAL HAND TOOL

[76] Inventor: Antonio Moreira, 17 Gail Rd., Merrimack, N.H. 03054

[21] Appl. No.: 819,429

[22] Filed: Mar. 17, 1997

[51] Int. Cl.[6] ..... B25G 1/00

[52] U.S. Cl. ..... 7/167; 81/489; 81/124.4

[58] Field of Search ..... 7/167, 158, 170; 81/489, 487, 329, 337, 339, 342, 124.4; 30/344

[56] References Cited

U.S. PATENT DOCUMENTS

| | | | |
|---|---|---|---|
| 202,105 | 4/1878 | Gladwin | 7/167 |
| 1,097,043 | 5/1914 | Nolder | 81/124.4 |
| 1,980,087 | 11/1934 | Rast | 7/167 |
| 2,737,704 | 3/1956 | Cinocca | 30/342 |
| 4,062,118 | 12/1977 | Modafferi | 30/339 |
| 4,512,381 | 4/1985 | Alvarez | 30/342 |
| 4,700,420 | 10/1987 | Belanger | 7/167 |
| 5,058,465 | 10/1991 | Womack | 81/487 |
| 5,615,746 | 4/1997 | Chu | 30/339 |

FOREIGN PATENT DOCUMENTS

| | | | |
|---|---|---|---|
| 72039 | 11/1893 | Germany | 81/124.4 |

*Primary Examiner*—Daid Scherbel
*Assistant Examiner*—Joni B. Danganan
*Attorney, Agent, or Firm*—Scott B. Garrison; Lambert & Garrison PLLC

[57] ABSTRACT

A multi-functional hand tool is provided having a handle portion to be held by a user. The handle portion is made to receive a plurality of different types of tool attachments. To secure these tool attachments, a plurality of slots are machined into an attachment portion of the hand tool. The attachment portion is simply a rigid element which can receive, retain and rigidly secure one of the tool attachments within one of the slots. The slots are sized differently to accommodate various marketed tool attachments, such as jig saw blades, reciprocating saw blades, utility knives, et. al. Further, putty knives, and striking implements can be made bearing a suitable tang for engaging one of the slots. The device is meant to be used as an all purpose sawing, cutting, scraping, spreading and striking implement which would replace a great deal of expensive tools commonly needed by apartment dwellers, students, and "do-it-yourselfers".

5 Claims, 5 Drawing Sheets

MULTI-FUNCTIONAL HAND TOOL

BACKGROUND OF THE INVENTION

The present invention relates to the field of hand tools. More particularly, it relates to a portable multi-functional hand tool which is adapted to receive multiple attachments for use in sawing, cutting, scraping, spreading and striking. The invention eliminates the need for purchasing or otherwise obtaining a variety of tools commonly used by homeowners or "do-it-yourselfers".

Most consumer products and dwellings require constant albeit usually minor repairs or adjustments to remain in usable condition. Commonly, the individual owning the appliance or house does not always have access to the proper tool to perform the task at hand. The result is that the individual must either immediately purchase the proper tool, or more likely substitute a tool readily at hand, consequently producing less than adequate results.

Commonly occurring domestic operations the individual is apt to face are: cutting an object to length such as a board for a shelf; cutting plastic or metal tubing; making non-linear, curving or multi-angled cuts; slicing linoleum, cardboard, or plastics; severing string or wire; scraping excess paint or putty from a surface and the removal of rust from surfaces; nailing tacks or picture hangers into a wall. To properly perform these functions an individual should have a reciprocating saw, or a crosscut hand saw for cutting wooden boards to length, a rip hand saw for ripping wooden boards to width, a finer toothed blade for cutting manmade wooden products; and an assortment of other blades for cutting other materials. Typically, jig saws are needed for cutting tight radii, whereas metal cutting reciprocating saw blades or hack saws are needed for cutting metals. Many other saw blades exist for cutting plastics, Formica, ceramic tile, and other non-wooden materials. A non-toothed blade such as a knife or razor is necessary for cutting linoleum, cardboard, textiles, and leather goods as well as scoring lines in manmade sheet goods such as plywood. Additionally, various styles of knife blades exist, each suited to a specific task or material. Putty knifes or scrapers serve to remove putty, paint, rust or labels from surfaces as well as to spread putty and various other spreadable compounds. Hammers should be used to nail tacks or other small nails or picture hangers properly.

The problem is that a large percentage of the population are wont in purchasing reciprocating saws, jigsaws, hacksaws, hammers, putty knives, hobby knives, or scrapers until such tools are needed. As stated, should the individual choose not to purchase the proper tool when needed, often times other tools on hand are substituted for the proper tools. However, this practice frequently results in damage to the tool, to the project, and even to the individual. Oftentimes the need for the tool is immediate, hence the substitution for an inappropriate tool. Although screwdriver devices exist which are adapted to receive a bit capable of engaging the most frequently encountered screws, there is no single tool of which Applicant is aware that accomplishes all of the above mentioned tasks.

SUMMARY OF THE INVENTION

What is needed is a multi-functional hand tool which alone can perform all of the functions often encountered. The hand tool would be provided with a plurality of interchangeable tool attachments including putty knives, various hobby knife blades, a striking head, scraper blades, and a multiplicity of jig saw, reciprocating saw, and sabre saw blades.

Accordingly, it is an object of the present invention to provide a hand tool comprising a simple durable structure having the capability to receive a plurality of interchangeable tool attachments. With the above object in view, a hand tool is provided having a heavy duty handle portion, a plurality of interchangeable tool attachments, and an attachment portion which accepts and retains one of the plurality of interchangeable tool attachments to the handle portion. The handle portion can be made of plastic or urethane based material. The attachment portion is permanently integrated into the handle portion thereby forming a single unitary piece.

Another object of the present invention is to provide a tool capable of attachably receiving a plurality of different width saw blades required for common non-industrial cutting operations.

It is still another object of the present invention to provide a tool possessing the flexibility of converting from one tool type to another by the simple substitution of blades.

Yet another object is to provide a hand tool capable of performing a majority of household cutting, scraping and striking actions comprising at least a hand saw, a scroll saw, a knife, a scraper, a putty knife, and a hammer.

It is still another object to provide a flexible hand tool for the hobbyist, student, apartment dweller, and other individual either not having access to task specific tools or not desiring to assemble and maintain a quantity of such tools.

BRIEF DESCRIPTION OF THE DRAWINGS

The novel features considered characteristic of the invention are set forth in the appended claims. The invention itself, however, both as to its construction and its method of operation, together with additional objects and advantages thereof, will best be understood from the following description of the specific embodiments when read and understood in connection with the accompanying drawing.

DETAILED DESCRIPTION OF THE PREFERRED EMBODIMENT

Figure 1:
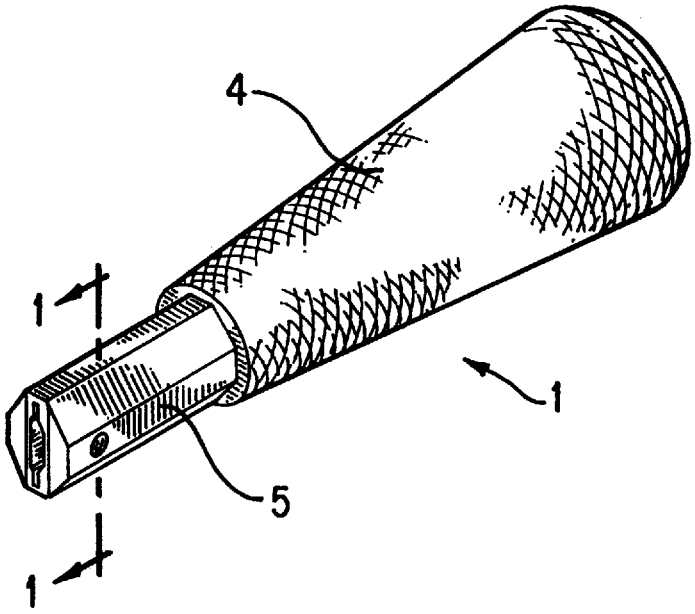
FIG. 1 is a perspective view of one preferred embodiment of a multi-functional hand tool without any attachments constructed in accordance with the present invention.

With reference to FIG. 1, a multi-functional hand tool 1 is provided generally. Said hand tool comprises a handle portion 4 and an attachment portion 5 internally retained within handle portion 4. The attachment portion 5 should be permanently integrated into the handle portion 4, however, there is no reason why it cannot be made removable so long as it can be securely fastened within handle portion 4. The handle portion 4 should be made of a heavy weight, durable, nonslip material. Some materials exhibiting the desired properties are urethane which lends itself to injection molding or metal which can be stamped or cast and subsequently machined or wrapped with rubber. However other materials could be used so long as the primary features that the attachment portion 5 be securely retained within the handle portion 4 and the material selected is suitable for use as a tool handle.

Figure 2:
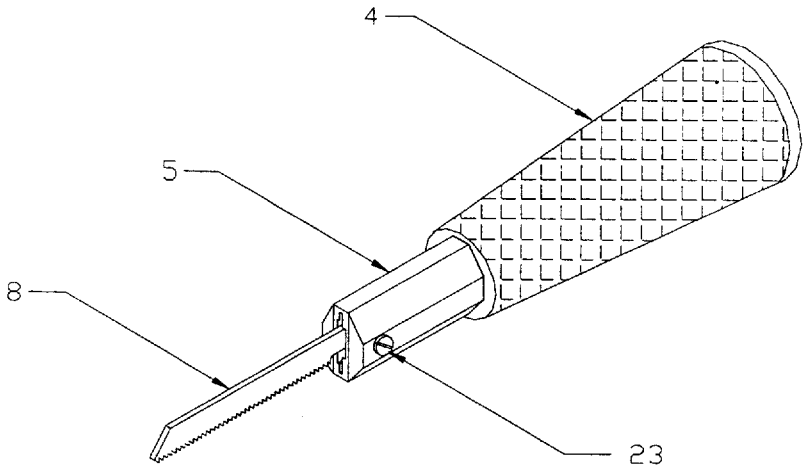
FIG. 2 is an enlarged perspective view of the FIG. 1 preferred embodiment further depicting a jig saw type blade attachably mounted to the FIG. 1 hand tool.
Figure 3:
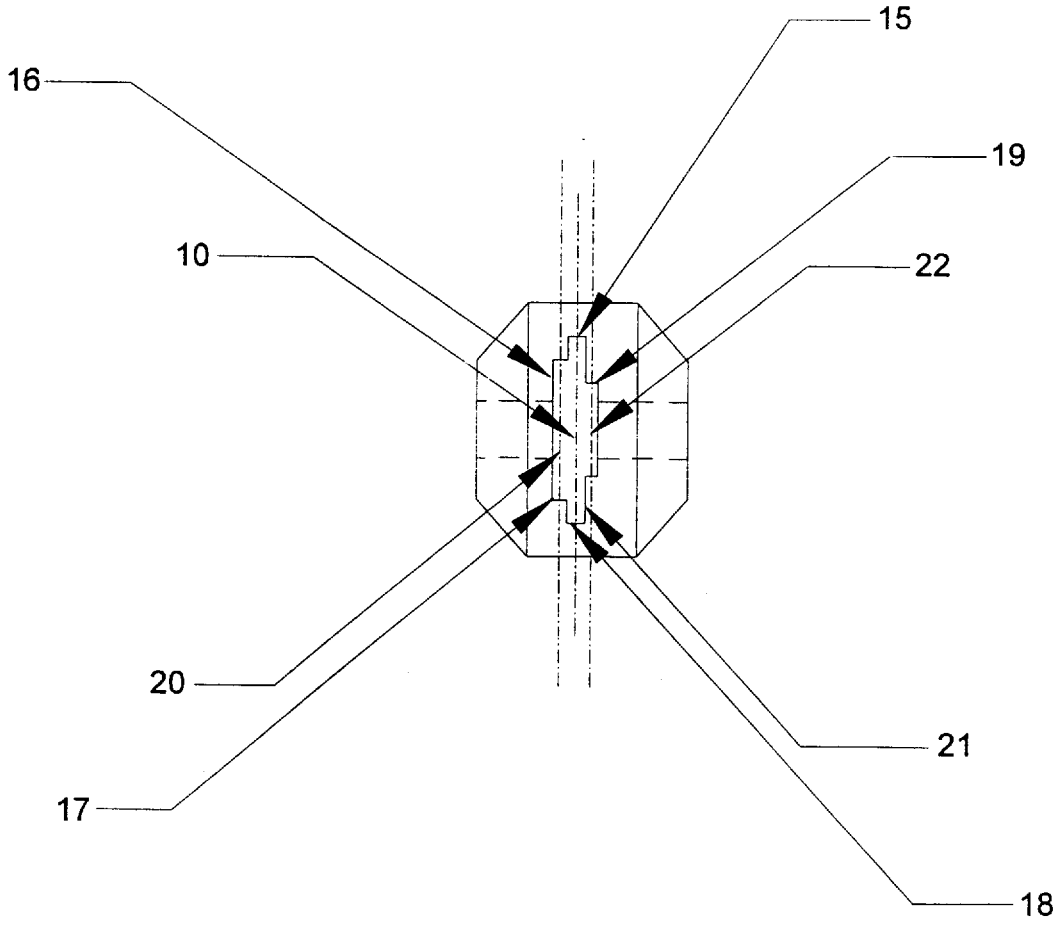
FIG. 3 is a cross-sectional view taken along the line 1—1 of FIG. 1 depicting a preferred arrangement of a tool attachment retaining channel capable of holding a plurality of different tool attachments.

Referring now to FIGS. 2 and 3, the multi-functional hand tool is shown deploying one possible type of tool attachment, a conventional jig saw blade 8. The jig saw blade 8 is inserted into a multi-stepped channel 10 and is rigidly held therein by at least one positive locking means such as a screw 23. However, other comparable locking means can be used so long as the locking means selected is capable of securely and rigidly locking the tool attachment in place within attachment portion 5. Although many configurations are possible and contemplated by the Applicant, a preferred embodiment to retain said tool attachments is a multi-stepped channel 10 as depicted in FIG. 3. FIG. 3 illustrates such a multi-stepped channel having three steps 17, 18, and 19 of differing height. Each of the steps 17, 18, and 19 are mirrored about an axis taken through a center of attachment portion 5. Therefore, each step actually provides an arrangement of contiguous slots 20, 21, and 22. Each of the slots has a width 15 and a height 16. One preferred embodiment locates a largest slot 21 at a vertical centerline of attachment portion 5 bounded on one side by a smaller slot 20 and bounded on the opposite side by yet a still smaller slot 22. This provides the hand tool with a small, medium and large slot. The Applicant considers this arrangement to be one preferred mode in which to arrange the slots however the actual arrangement of the slots is not critical to the operation of the hand tool. Many other arrangements would work suitably well; whether the slots were adjacent, separated by material comprising a portion of the attachment portion, or arranged in a completely different pattern.

Figure 4:
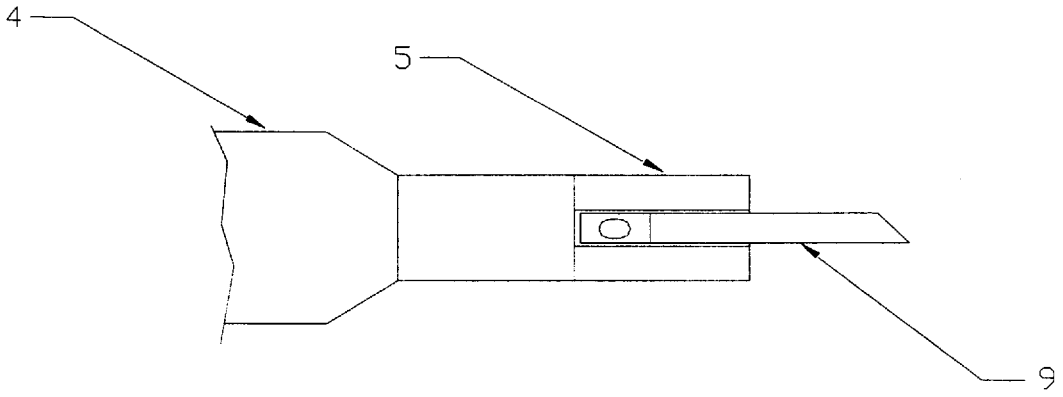
FIG. 4 is a partial sectional view depicting a tool attachment engaged within the FIG. 1 hand tool.
Figure 5:
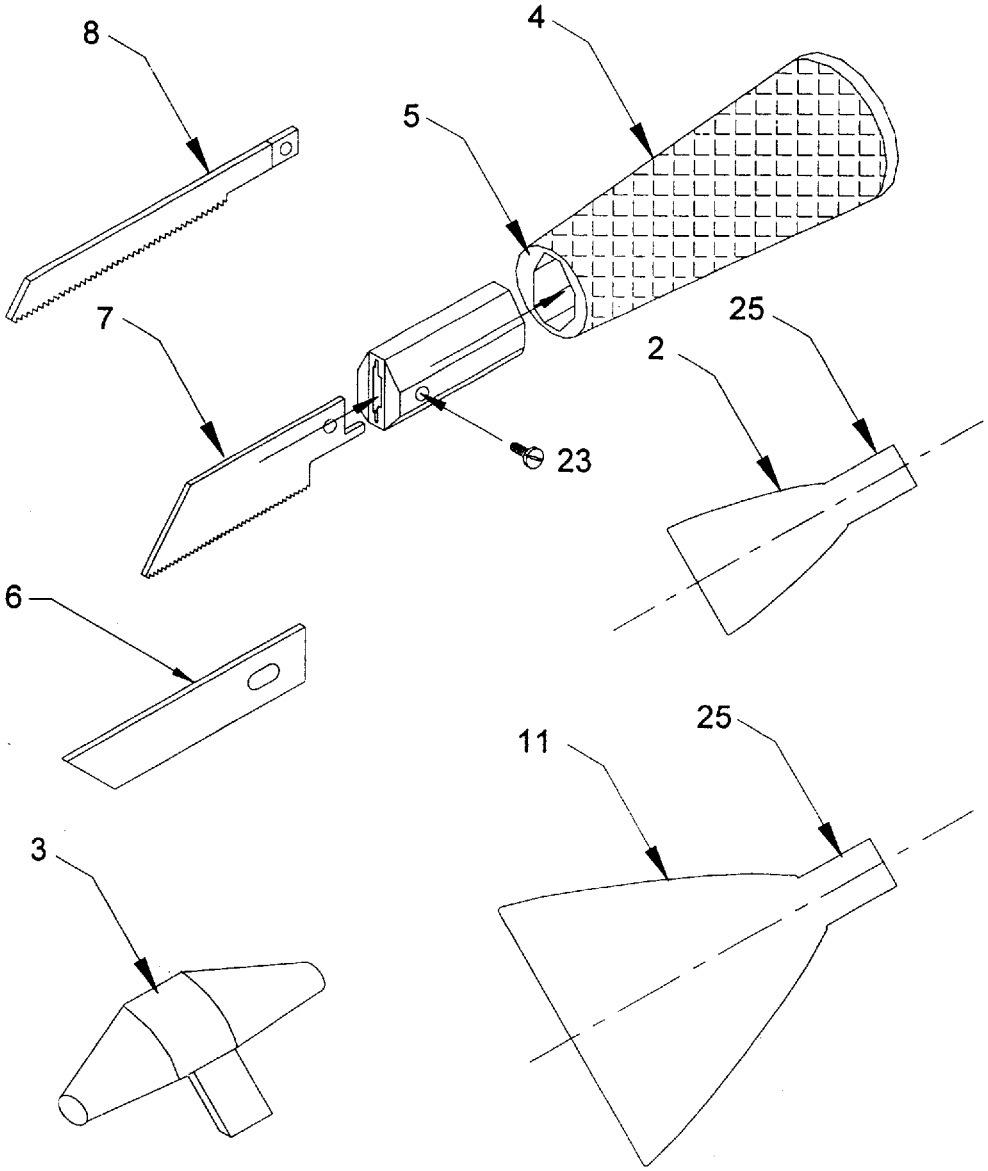
FIG. 5 is an exploded perspective view of the FIG. 1 hand tool depicting a plurality of tool attachments capable of mounting to the FIG. 1 hand tool.

What is critical to the tool construction is that at least some of the slots be capable of slidingly receiving and retaining standard or conventional industry sized saw or utility knife blades therein. For instance, as shown in FIG. 4, the small slot, slot 22 is capable of receiving a knife blade 9 often known in the industry as a hobby type utility knife blade. Coincidentally, slot 22 is also sized to receive a jig saw blade 8. Slot 20, the medium slot, is capable of receiving a heavy duty type utility knife blade 6. The large slot, slot 21 is sized to receive a reciprocating saw blade 7. Additionally, further tool attachments such as a large and small scraper 11 and 2 respectively and a hammer 3 are provided which in the preferred embodiment slidingly engage and are secured within slot 21. A suitable tang 25 would be provided to engage said slot. As stated above, each of these tool attachments must be securely retained within its respective slot. As such the height 16 of each slot is dimensioned to readily receive its intended tool attachment but is no larger than necessary. The width 15 must be at least as wide as the tool attachment with which it is to be engaged therein. As can be seen in FIG. 4, the fit of each tool attachment is as tight as practical without rising to a level which significantly interferes with a user being able to slide the particular tool attachment in or out of the slot. This ensures that the tool attachment securely contacts the slot edges along the entire communicating surface thereby eliminating the potential for the tool attachment to otherwise pivot.

Applicant has determined that based upon the disclosed preferred embodiment of multi-stepped channel 10, a suitable means for securely retaining the tool attachment is to provide two of screws 23. Each of these screws 23 are arranged opposite one another and threadingly extend one toward the other. As can be easily envisioned by FIG. 3, placing a tool attachment within the proper slot and tightening each of screws 23 in a manner which will not shift the tool attachment to an incorrect slot is easily accomplished. Once screws 23 contact the tool attachment, additional tightening of screws 23 frictionally secures the tool attachment within the attachment portion 5. It is important that the tool attachment be rigidly and nonmovingly secure within attachment portion 5 and Applicant has found that the described apparatus provides ample rigidity when screws 23 are tightened and the tool attachment is inserted in the properly sized slot.

The apparatus could be made in kit form wherein a plurality of tool attachments are provided bundled with the tool 1 or the user could obtain blades at a later time. However, the Applicant has provided only one possible embodiment of the device detailed above, which constitutes the preferred embodiment to the invention. The Applicant is aware that numerous configurations are available, some of which have been referred to above, which would provide the desired results. While the invention has been described and illustrated with reference to a specific embodiment, it is understood that these other embodiments may be resorted to without departing from the invention. Therefore the form of the invention set out above should be considered illustrative and not as limiting the scope of the following claims.

What is claimed is:

1. A multifunctional hand tool comprising:

a handle portion;

an attachment portion having a first and a second end, said first end partially disposed within and contained by said handle portion, said second end partially protruding axially from said handle portion;

a plurality of slots located at said second end of said attachment portion arranged contiguously one next to the other so as to form a multi-stepped channel; each of said slots having a height and a width, wherein at least some of said slots have a different height than some others of said slots, and each of said slots is capable of receiving a tool attachment slidingly therein; and a locking means for securely locking said tool attachment rigidly within one of said slots.

2. A multifunctional hand tool as claimed in claim 1 wherein said tool attachments include, scrapers, saw blades, striking implements, putty knives and knives; wherein at least a portion of said scrapers, saw blades, striking implements, putty knives and knives are standard manufactured tool items bearing a tang means for engaging a standard tool handle; and at least one of said slots is dimensionally suitable for engaging said tang means thereby enabling use of said tool item with said multi-functional hand tool.

3. A multifunctional hand tool as claimed in claim 2 wherein said locking means is at least one screw which frictionally contacts said tool attachment thereby binding said tool attachment against a wall of said slot.

4. A multi-functional hand tool as claimed in claim 2 wherein said locking means comprises two opposing screws, each frictionally impinging upon said tool attachment from opposite sides.

5. A multi-functional hand tool as claimed in claim 2 wherein said standard manufactured tool items bearing a tang means further comprise jig saw blades, reciprocating saw blades, and utility knives.

* * * * *